US006412744B1

(12) United States Patent
Wollam et al.

(10) Patent No.: US 6,412,744 B1
(45) Date of Patent: Jul. 2, 2002

(54) MONITOR MOUNTED PERSONAL ORGANIZER

(75) Inventors: Robert H. Wollam; Mushtaq Ali Kalwar, both of Orlando, FL (US)

(73) Assignee: Dream Find, Inc., Winter Park, FL (US)

( * ) Notice: Subject to any disclaimer, the term of this patent is extended or adjusted under 35 U.S.C. 154(b) by 0 days.

(21) Appl. No.: 09/696,380

(22) Filed: Oct. 25, 2000

Related U.S. Application Data

(60) Provisional application No. 60/162,733, filed on Oct. 29, 1999.

(51) Int. Cl.[7] ..... B41J 11/02

(52) U.S. Cl. ..... 248/442.2; 248/447.1; 248/452; 248/918; 40/594

(58) Field of Search ..... 248/442.5, 447.1, 248/452, 918; 40/611, 651, 594, 725

(56) References Cited

U.S. PATENT DOCUMENTS 4,869,565 A * 9/1989 Bachman ..... 312/234
5,104,087 A * 4/1992 Wentzloff et al. ..... 248/442.2
5,328,145 A * 7/1994 Charapich ..... 248/442.2
5,398,905 A * 3/1995 Hinson ..... 248/442.2
5,499,793 A 3/1996 Salansky ..... 248/442.2
5,549,267 A * 8/1996 Armbruster et al. ..... 248/442.2
5,664,673 A * 9/1997 Perry ..... 206/371
5,672,105 A * 9/1997 Curic ..... 462/72
5,678,792 A 10/1997 Arguin et al. ..... 248/205.1
5,880,713 A * 3/1999 Belardinelli ..... 345/156
5,988,582 A * 11/1999 Olivo ..... 248/442.2

* cited by examiner

*Primary Examiner*—Leslie A. Braun
*Assistant Examiner*—Deborah M. Brann
(74) *Attorney, Agent, or Firm*—Brian S. Steinberger; Law Offices of Brian S. Steinberger, PA

(57) ABSTRACT

Adjustable display board for attachment to a monitor housing so that items such as notes, calendars, nameplates, pads, mirrors, writing implements, and keys can be mounted adjacent to a monitor screen. The display board can be constructed from molded parts which can flex and/or be molded to fit the contours of various monitor housings. The display board includes a left side frame, a right side frame and a top holder panel that interconnects upper horizontal legs of the left and right side frames. The top holder panel slides along the upper horizontal legs of both the left and right side frames providing the ability to adapt to different monitor sizes and shapes. The top holder panel has retaining edges molded for the purpose of holding various objects such as photographs, messages and other indicia on both of its sides. The left and right side panels provide a surface that functions as a decorative message board and provides a means to attach various other objects temporarily or permanently to it. Additionally, the board surface can be written on and erased similar to a blackboard.

18 Claims, 7 Drawing Sheets

MONITOR MOUNTED PERSONAL ORGANIZER

This invention relates to display boards and display panels, and in particular to a display board that can be attached to a monitor housing of a PC computer, a laptop computer, and a television, and used for organizing, advertising or adding visual appeal to the monitor housing, and claims the benefit of U.S. Provisional Application No. 60/162,733 filed Oct. 29, 1999.

BACKGROUND AND PRIOR ART

Since the advent of computer monitors being used on most desks, it has become increasingly popular for the computer user to attach reminder notes, information and other items on the computer monitor. In addition, users also prefer to personalize their areas with pictures, photographs and other personal items. Many users attach items around their monitor's bezels, but due to limited space, these items do not fit and usually extend into the viewable portion of the monitor screen or protrude into the air space around the monitor.

With the increased size of computer monitors having fourteen inch screens, 17 inch screens, and the ever more popular 20 inch screens there is less and less surface space about the perimeter edges of the monitor screens.

Thus, there is a need to increase their usable space to accommodate these items. A display board which attaches to a monitor housing would provide extra space and functions as a messaging/personalization area for the user.

Over the years, various ideas have been proposed to solve these problems. U.S. Pat. No. 4,869,565 to Bachman discloses an adjustable display apparatus which consists of several pieces, between five and seven that must be separately mounted to the top and sides of the display monitor. Although, the device is entitled a "universally adjustable display apparatus", the device have several problems and deficiencies. The Bachman device is not aesthetically pleasing because the display surfaces 14, 16 shown in side view of FIG. 2 are in two different planes, and could either show a gaping hole in the front view of FIG. 1, or an over-lapping surface. Additionally, the user will always be able to see the several mounting channels that must be used to hold the display panels. The design also places the usable surface away from the user. Also, the variable pieces and attachments for the monitor housing would be costly to manufacture and difficult to assemble by a novice user. The stability of the unit is also compromised by the single dimension mounting surface, and being a substantially flat surface requires all accessories to be somehow attached to the display board. Furthermore, the four channel members 18, 20, 22, 24 would need to be rigid for attaching the L-shaped members 14 and 16. Thus, the rigidity of the channels would preclude the Bachman device from conforming to display monitors having curved side and front edges.

U.S. Pat. No. 5,104,087 to Wentzloff discloses a fixed display board holder with inserted display panels. This design is also difficult to assemble, costly to construct and provides a flat surface back away from the plane of the display screen. In addition, it is not adjustable to fit various sized monitor housings. Instead, the Wentzloff device would require different size display boards for each different size monitor housing.

Screenies is a another type of display panel, a flat, non-adjustable panel which attach to the front of monitor housing, and has been marketed for a number of years now.

U.S. Pat. No. 5,638,096 to Schwartz describes a flat multi-layered device that attaches to the front of a monitor housing. This device is inexpensive to produce, but since it surrounds the monitor it obscures many of the monitor controls which are usually located at the bottom of a monitor. It is also unitized construction of a flat device that must be manufactured in different sizes to fit different size monitors; and it is not adjustable. Having a flat panel attached to the front of a monitor will also not mount firmly to a curved monitor screen which encompass large monitors commonly in use today.

U.S. Pat. No. 5,549,267 to Armbruster describes flat panel mounted to the front of a monitor. Although this device may be cost effective to produce, the Armbruster device is not adjustable and must be manufactured in different sizes to fit different sized monitor housing. It also suffers from the same problem of attachment to curved screen monitors, since it is only a flat panel and will not fit a curved monitor face.

U.S. Pat. No. 5,328,145 to Charapich (1994) describes another large flat panel display board which would be expensive to construct and difficult to attach by a novice user. Although it adds stabilizers to help secure the display panel to the monitor housing, it is not adjustable to fit various size screens. The device has a single sized opening for the monitor screen. For curved screen monitors there would be large gaps between the panel and the monitor housing at the sides and corners producing an unattractive look.

Thus, there is a need for solutions to the above problems that exist with the prior art types of display boards.

SUMMARY OF THE INVENTION

The primary objective of the invention is to provide an adjustable display board for which one size fits a wide range of monitor housing sizes such as but not limited to fourteen inch monitors, seventeen inch monitors, twenty inch monitors, and the like.

The secondary objective of the invention is to provide an adjustable display board that can be securely mounted to monitor having different contours such as but not limited to flat and curved monitors.

The third objective of the invention is to provide an adjustable display board that provides side and top surface panels in the same plane near the plane of the monitor display.

The fourth objective of the invention is to provide an adjustable display board that has side and top surface panels which overlap over the top and side edges of a computer monitor without covering the monitor screen.

The fifth objective of the invention is to provide an adjustable display board that has two side panels that can mount in the vertical and top forward corners of the monitor housing, while providing a single top adjustable receptacle panel with built-in indicia holders on both the front and back of the top panel.

The sixth objective of the invention is to provide an adjustable display board for monitors that has holding areas within the display board to mount indicia without the need of clips or other additional mounting fasteners.

The seventh objective of the invention is to provide an adjustable display board for monitors that can be inexpensively manufactured with variations in color and translucency.

The eighth objective of the invention is to provide an adjustable display board for monitors having an erasable surface on the display board on which a dry marker can be used and erased and reused.

The ninth objective of the invention is to provide an adjustable display board for monitors that is durable, easily producible with an aesthetic appeal to the user.

The tenth objective of the invention is to provide an adjustable display board for monitors that includes an attachable a single panel which functions as both a pen holder and a note pad holder, where the panel can be formed from a single manufacturing process adding function while reducing product manufacturing costs.

The eleventh objective of the invention is to provide an adjustable display board for monitors that can be manufactured in 2-D and 3-D shapes and be texture molded into the unit while maintaining low unit costs.

The twelfth objective of the invention is to provide an adjustable display board for monitors that can be inexpensively, and permanently marked with advertisement or other personalization features from manufacturers and/or sellers.

The thirteenth objective of the invention is to provide an adjustable display board that can be constructed to have the same look and feel as the monitor housing to which it will be mounted, which allows both the monitor and the display board to be matched and aesthetically appealing.

The fourteenth objective of the invention is to provide an adjustable display board for monitors that is safe, easy to install, easy to assemble, and take apart without damage to the monitor.

The fifteenth objective of the invention is to provide an adjustable display board for monitors that is lightweight and long-lasting, and able to support a variety of indicia mounted thereon.

A preferred embodiment of the adjustable display board for monitors includes a left side panel having an upper horizontal leg and a lower-vertical leg arranged in an L-shape to one another, the left side panel having a single front planar surface, a right side panel having an upper horizontal leg and a lower vertical leg arranged in an L-shape to one another, the right side panel having a single front planar surface, and a top holder panel having a left end and a right end, the left end for allowing a portion of the upper horizontal leg of the left side panel to slidably fasten to the left end, the right end for allowing a portion of upper horizontal leg of the right side panel to slidably fasten to the right end, wherein the left side panel, the right side panel and the top holder panel fit over and in front of a left side edge, a right side edge and a top edge of a monitor, and the single front planar surface of the left side panel and the single front planar surface of the right side panel are identical.

The left side panel, the right side panel and the top holder panel can be formed from a flexible plastic material that can flex and conform to monitors having curved surface faces.

Both the left side panel and the right side panel each have a rear face with a member protruding perpendicular behind, and the single front planar surface of the left side panel and the right side panel each have a t-cross-sectional shape to their respective rear facing perpendicular members, so that a portion of the rear protruding member of both the left side panel and the right side panel can abut against outer side edges of the monitor, while front edges of the left side panel and the right side panel which face one another overlap front face edge portions of the monitor.

The top holder panel can include at least one track for holding both the upper horizontal leg of the right side panel and the upper horizontal leg of the left side panel to the top holder panel. The top holder panel can further include supports on the front surface and/or the rear surface such as channel edges for supporting card shaped items such as but not limited to calendars, photographs, name plates and business cards thereon.

An extra item holder can be attached to the front of the adjustable display board for supporting various items such as a writing implement, a pad and a key. The extra item holder can have a slanted front face with a bottom lip edge for supporting a pad, and/or a round opening for supporting the writing implement and/or a hook for supporting key(s). A mirror can also be attached to the adjustable display board when desired.

The display board can be molded in a polypropylene or other non-porous plastic. The surface of the board can function as a dry marker board erasable surface, and be colored or tinted to provide a variety of aesthetic looks and appeal. The display board can be used to attach various indicia thereon wherein the indicia can be temporary or permanent. The display board can be hot stamped, decaled, stickered or silk screened to provide decoration, logos, advertising or other form of art or messaging.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
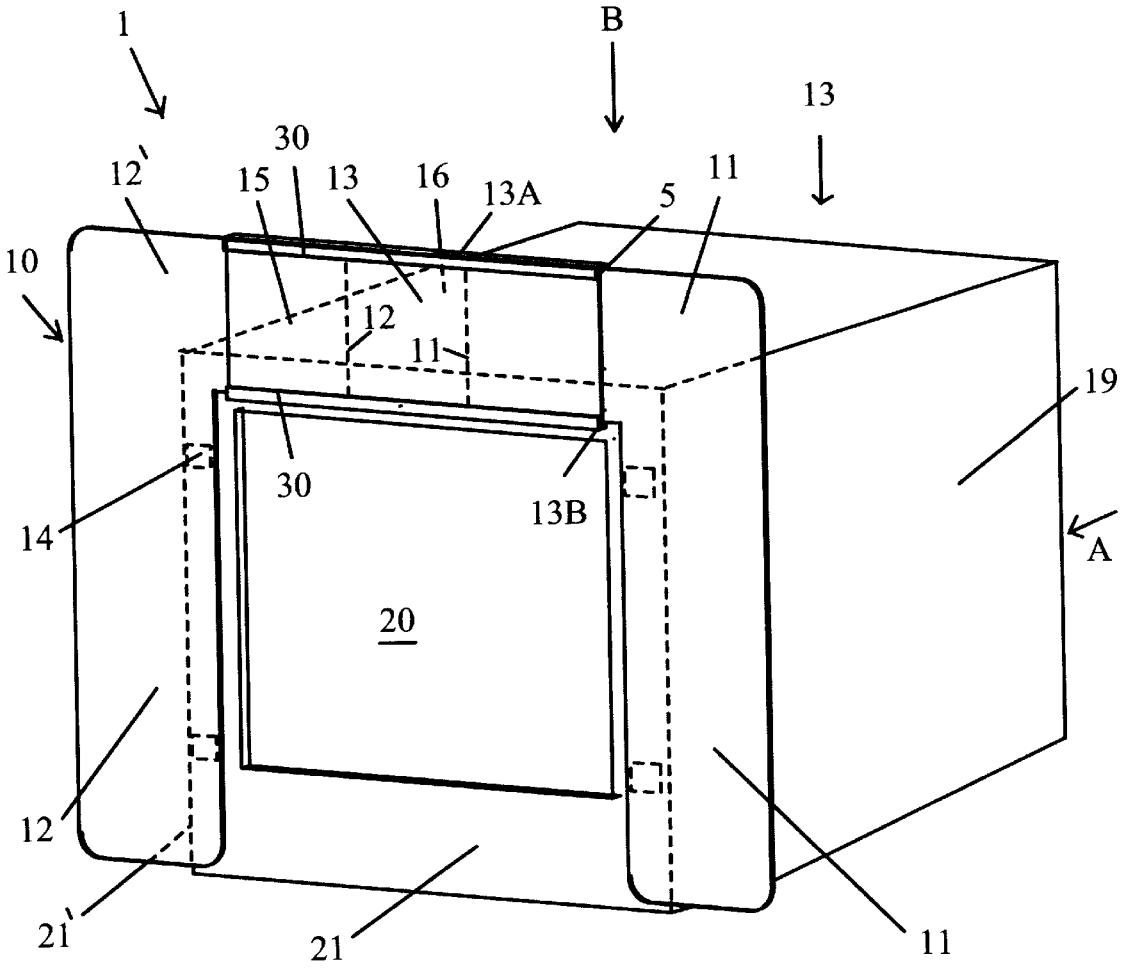
FIG. 1 is a perspective view of the first embodiment of the display board invention attached to a monitor housing of a personal computer.
Figure 2:
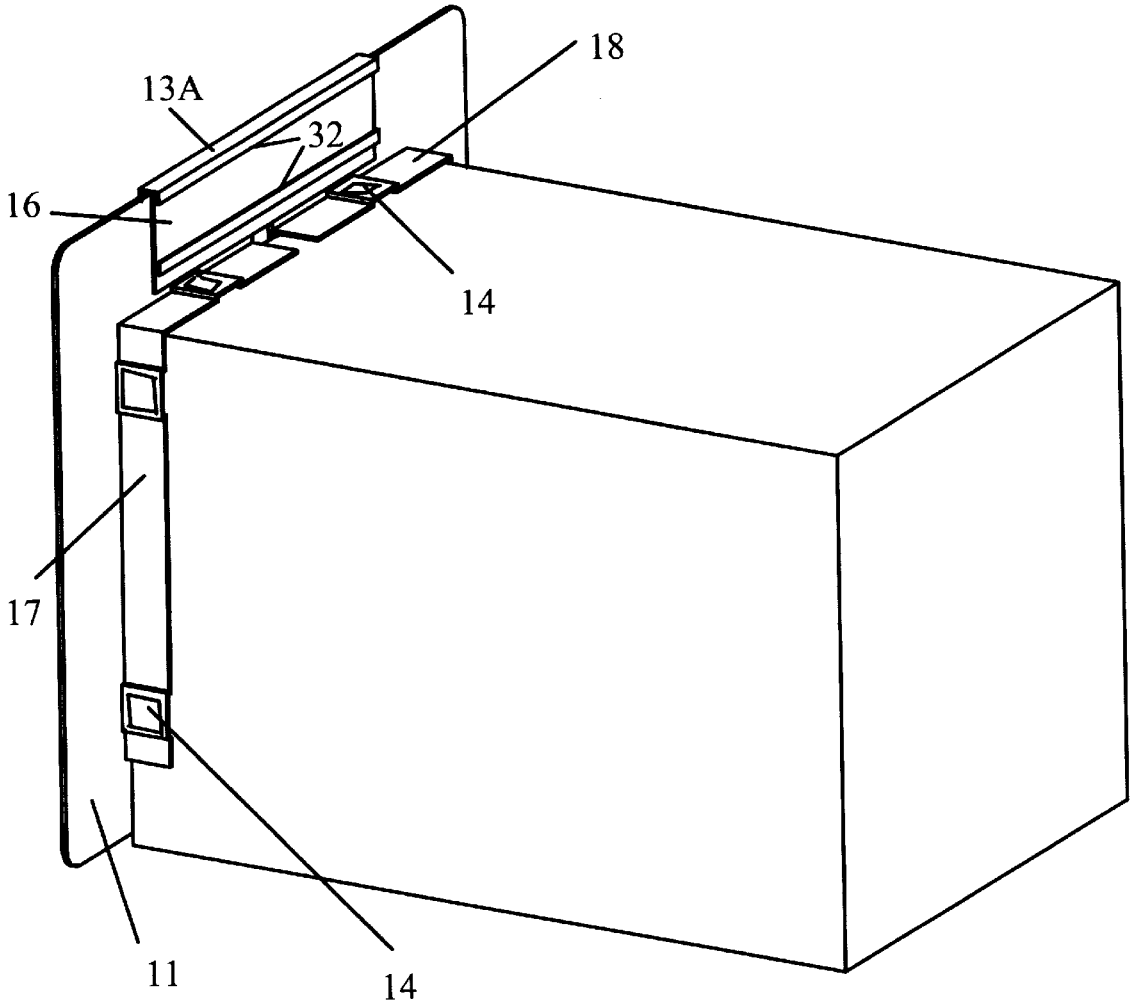
FIG. 2 is a perspective side view of the display board invention of FIG. 1 along arrow A.
Figure 3:
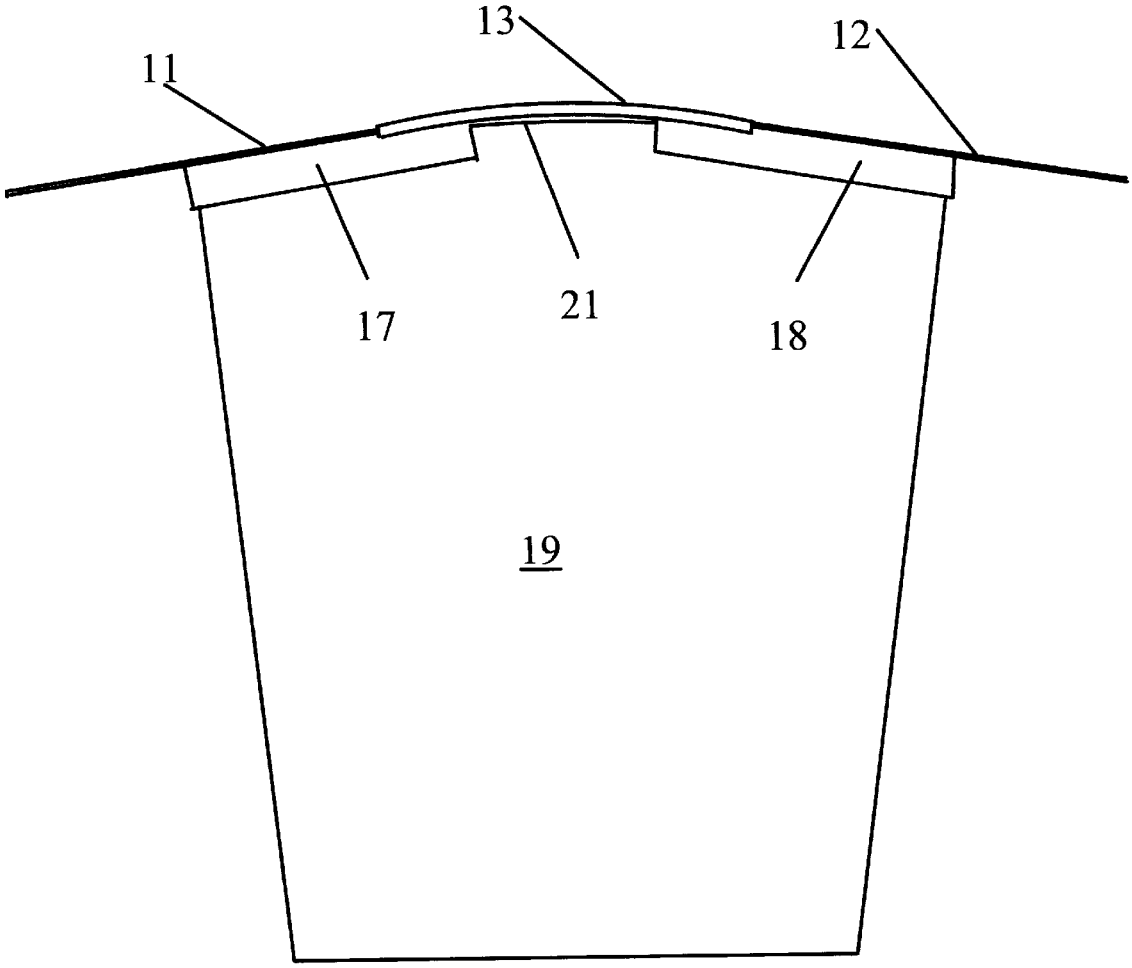
FIG. 3 is a top view of the display board invention of FIG. 1 along arrow B.

FIG. 1 is a perspective view of the first embodiment 1 of the display board invention 10 attached to a monitor housing 19 of a personal computer. FIG. 2 is a perspective side view of the display board invention 10 of FIG. 1 along arrow A. FIG. 3 is a top view of the display board invention 1 of FIG. 1 along arrow B.

Referring to FIGS. 1–3, the display board assembly 10 consists of three basic pieces, a right side display panel 11, a left side display panel 12 and a top holder panel 13. Each of these parts can be constructed of a single piece of molded plastic or similar material, such as but not limited to polypropylene, non-porous plastics, and the like. Each piece can be made to be flexible to bend to the surface contours of curved monitors.

The color and material of each piece of the display board can be accommodated from the same mold allowing variation in look and feel of the frame to meet variations in consumer tastes. Furthermore, since the display board consists of different molded pieces, each material and color may be assembled with dissimilar items to produce further marketable versions of the product with minimal increases in cost.

Referring to FIGS. 1–3, the right display panel 11 has a planar front in the general shape of an inverted L, with a T-cross sectional shape. The rear facing flange 17 protrudes substantially perpendicular from the rear side of the panel 11. The inner edge of the right side panel 11 overlays on a front portion of the outer edge 21' of the monitor front bezel 21 on the right side of the monitor housing 19 without obstructing a user's view of the monitor display tube 20. The left side display panel 12 and rear facing flange 18 is a mirror image of the right side display panel 11, mirrored about the vertical axis. Similarly, left side display panel 12 overlays on a portion of the monitor front bezel 21 on the left side of the monitor housing 19 without obstructing a user's view of the monitor display tube 20. The right and left side display panels 11, 12 can be attached to the monitor 19 in a plurality of areas along the back and rear facing flanges 17, 18 of the side panels 11, 12 and the front 21 of the monitor housing and the inside edge of the left and right flanges and the monitor housing, by fasteners 14 such as but not limited to strips of releasable mating hook and loop fasteners (Velcrot®), double sided foam tape, and the like.

Top holder panel 13 can include a front face 15 connected at an upper edge 13A and a bottom edge 13B to a rear face panel 16 with a longitudinal slot S, therebetween. The slot S of the top holder panel 13 can slidably receive ends 12" and 11" of the horizontal legs 12', 11' of the left display panel 12 and the right display panel 11. On the front face 15 of top holder panel 13 can be channel tracks 30 having L cross-sectional shapes, for holding cards such as photographs, business cards, and the like thereon. Similarly, on the rear face 16 of top holder panel 13 can be two channel tracks which face one another for similarly holding cards such as photographs, business cards, calendars, and the like, thereon.

Since the top holder panel 13 is constructed of a flexible material, it can conform to the curvature of the monitor in the horizontal dimension allowing the left side panel 12 and right side panel 11 to attach to the monitor housing 19 in different planes. The top holder panel front surface 15 is molded with channel track edges 30 (such as raised L-shaped edges which face one another) which allows card type objects having a flat surface of similar size to slide into the top holder panel 13 from either the left or right side, thereby retaining the item without the need of additional mounting materials. The top holder panel 16 rear surface is molded at top and along a mid-portion with similar channel track edges 32 to those channel tracks 30 of the front face 15.

The display board invention 10 can be adjustable to fit a wide variety of monitor housings since it horizontally expands and flexes against the monitor frame front face to follow the contour of the housing. Once the molds are created, variations in the device can be achieved through the selection of material and color used in the manufacturing process. This allows mass production and low cost to be maintained while achieving a variety of aesthetically appealing looks to the basic product.

The built in holders 30, 32 formed on the front 15 and back 16 of the top holder panel 13 provides the ability to quickly add photographs, name plates, calendars, business cards, and other indicia without the need for additional mounting hardware. Mattes and transparent sheet material can also be accommodated by the holder to make the holder into a picture frame. The rear facing flanges 17, 18 on the left and right side panels 12, 11 not only act as a stabilizing feature but also cover any separation between the monitor housing and the display panel, providing a more aesthetically appealing product that is not possible with flat panels.

Since the display board invention is constructed of a durable plastic, it the device resistant to stains and scratches and allows the device to be easily cleaned.

Since the device consists of primarily three parts, it is easily installed and removed from a monitor housing without the need for any special tools or skills.

To install the display board, remove the protective tabs from the adhesive pads on the right side frame 11. Align the top right corner of the monitor housing 19 with the corner of the flange on the right side panel. Then firmly press the side panel to the monitor housing around each adhesive pad. To assemble the display board, the user slides top leg 11" of the right side panel 11 into slot S in top holder 13. Remove the protective pads from the adhesive pads on the left side panel 12, and slide the top left slide leg 12' into the slot S in the top holder panel 13. Align the top left corner of the monitor housing 19 with the corner of the flange on the left side panel 12. Then firmly press the side panel 12 to the monitor housing around each adhesive pad.

For removal start with the bottom of the right side panel 11 leg and pull diagonally away from the intersection of the front 21 and side of the monitor housing 19 until all mounting tabs on the right side panel are separated from their mates. Remove the right side panel 11. Remove the top holder panel 13 by sliding the top holder panel off the left side panel 12 leg. Pull the left side panel 12 from the bottom diagonally away from the monitor housing 19, until all mounting tabs are separated. Then the left side panel 12 can be removed.

Once the adjustable display board 10 is mounted to a monitor housing 19, personal items can be inserted into the top holder panel 13 by sliding them into it from the left or right sides. This procedure is the same for both the front and back of the top holder.

The adjustable display board can be used on a wide range of monitor housings and made with a large range of styles and options. It is not only easy to attach and remove the adjustable display board from a monitor housing, it provide a fit to the housing better than any previous designs.

Being firmly attached on three substantially perpendicular planes (front sides and top of the monitor housing) provides a stable mounting which will support loading the adjustable display board with organizational and personal items.

Since the display board is molded under substantial pressure, it provides a durable marking surface without the need for extra protective layers applied to the surface.

The top holder panel allows the user a better arrangement to personalize the unit to their taste.

Figure 4:
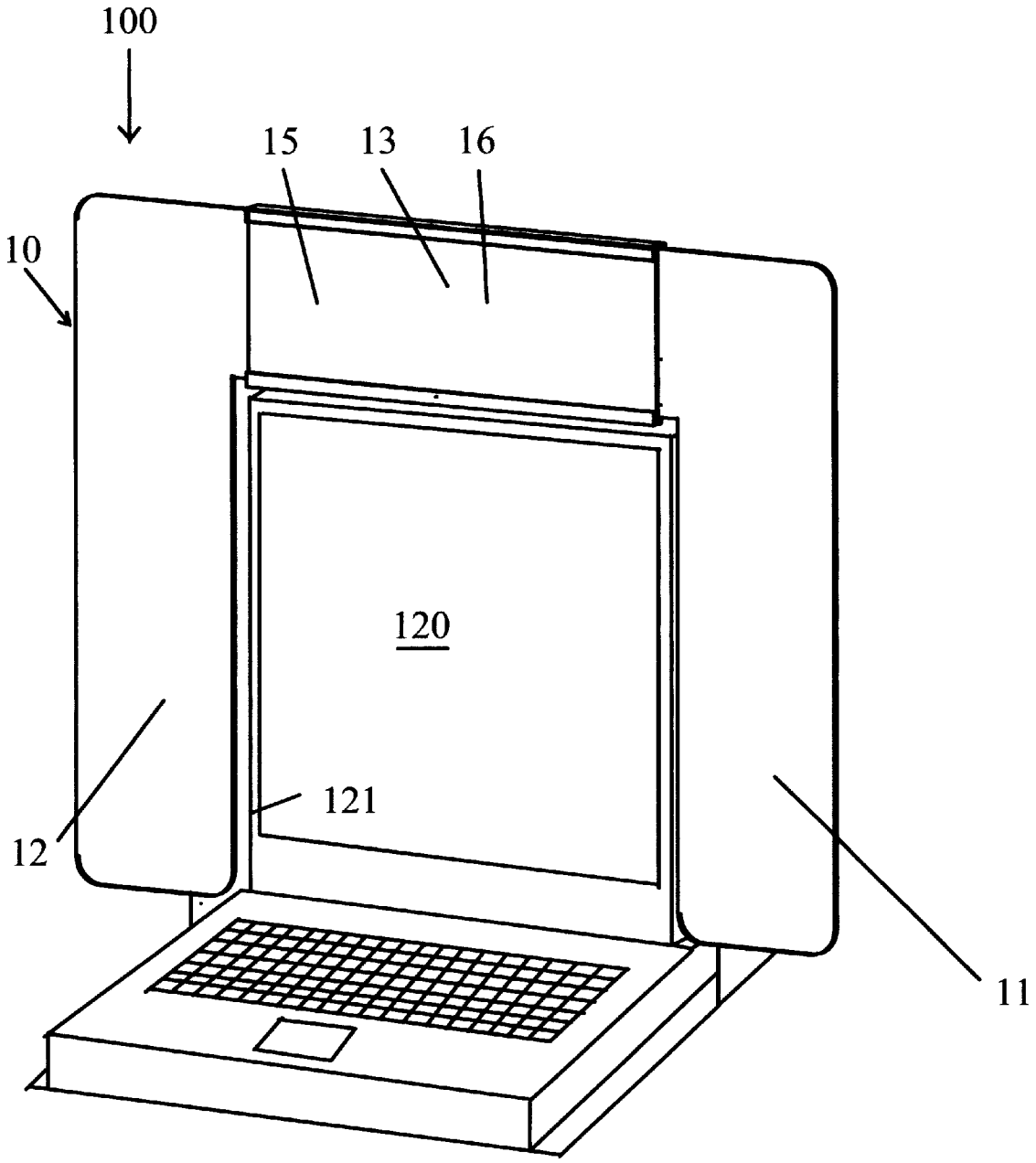
FIG. 4 is a perspective view of the display board invention attached to a monitor on a laptop computer.

FIG. 4 is a perspective view 100 of the display board invention 10 attached to a frame edge 121 on the monitor 120 on a laptop computer, in a manner similar to the monitor previously described in relation to FIGS. 1–3.

Figure 5:
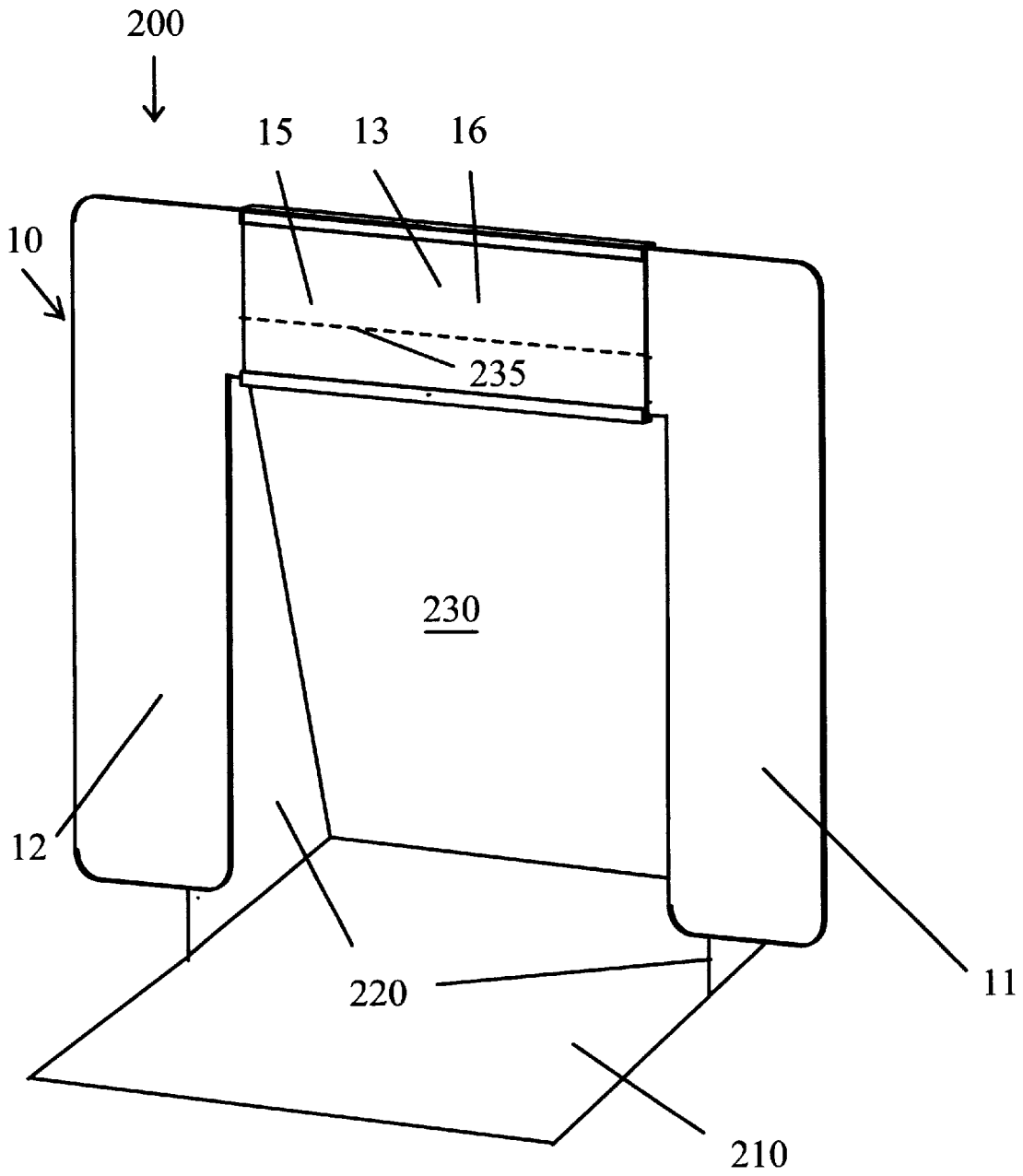
FIG. 5 a second embodiment of the display board invention attached to a support stand.

FIG. 5 a second embodiment 200 of the display board invention 10 attached to a support stand having a flat base 210, triangular side legs 220 and a rear wall 230. Here the display board rear facing flanges 17, 18 can abut about the outer surfaces of the side legs 220 and the upper rear wall edge 235. The stand arrangement 200 can be used when the invention has been removed from the laptop computer 100 previously described.

Figure 6:
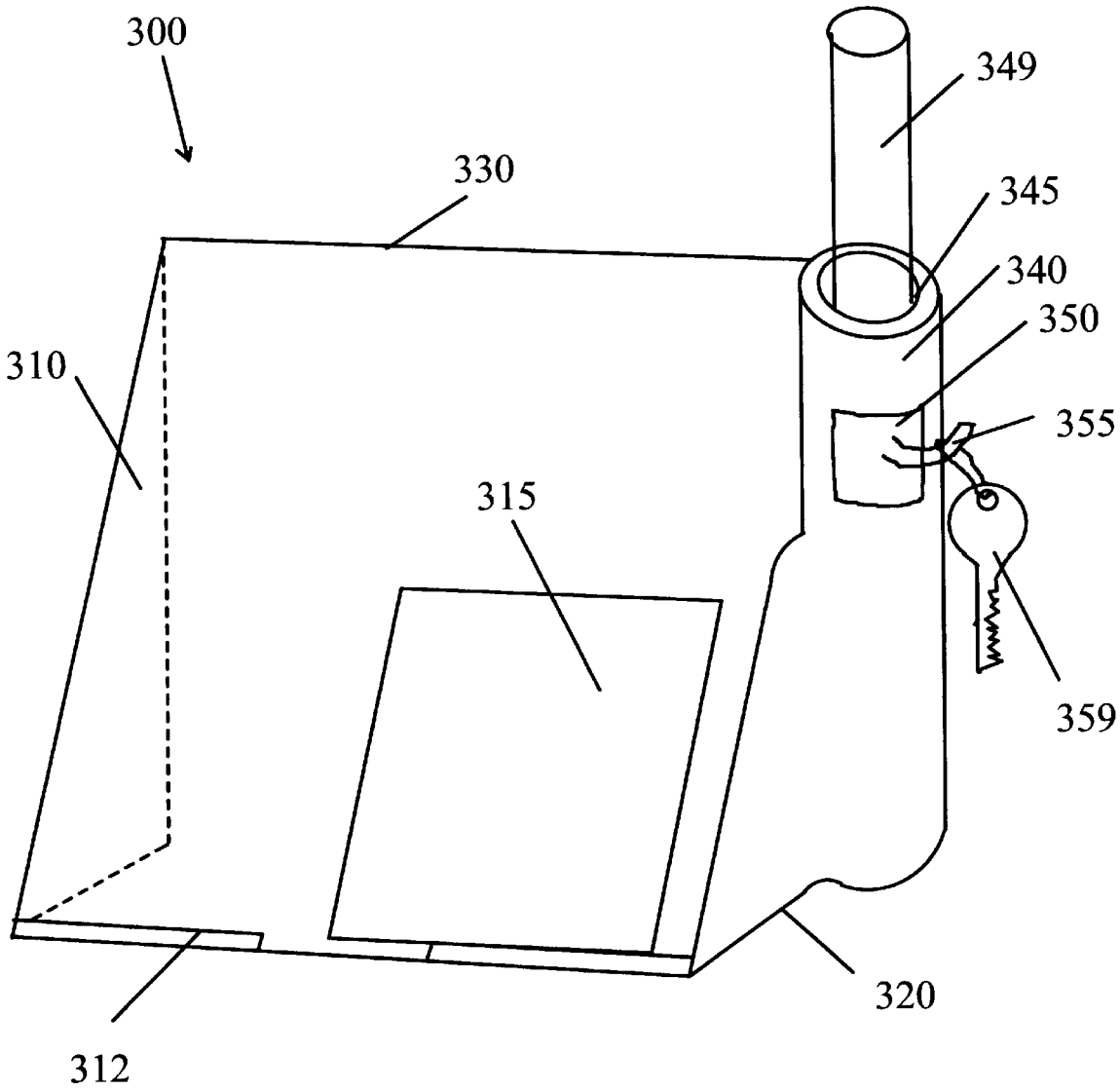
FIG. 6 is a perspective view of an extra item holder for supporting a pad and pen.

FIG. 6 is a perspective view of an extra item holder 300 for supporting a pad and writing implement such as a pen, pencil, and the like, thereon. Holder 300 can be molded from plastic and include a front slanted face 310 with a raised lower edge 312 for supporting a paper pad 315, a flat bottom 320 and a flat rear face 330 that can have well known fasteners (not shown) such as those previously described (i.e. hook and loop fasteners, double sided-tap, and the like), and a side tubular holder 340 having a round opening 345 for supporting a writing implement 349 therein, and a hook 355 with detachable base 350 having similar fasteners to those previously described, for supporting other items, such as but not limited to keys 359, and the like.

Figure 7:
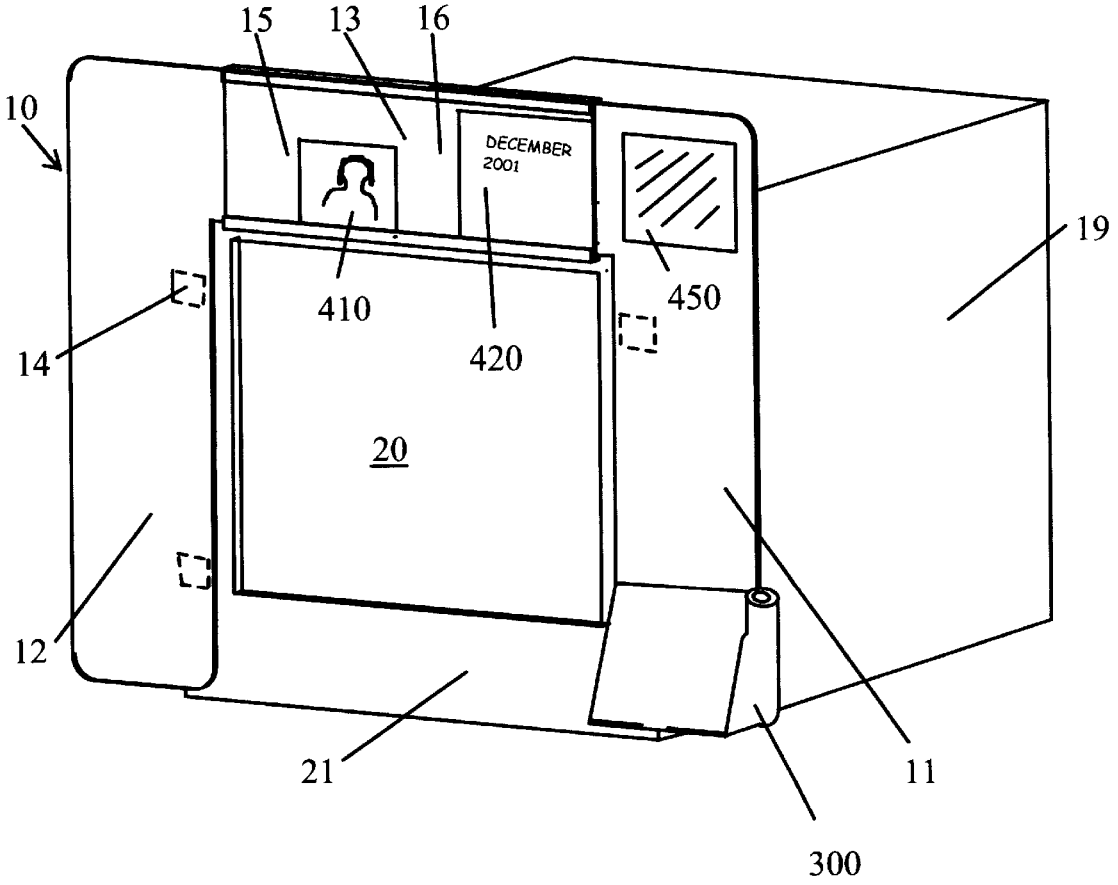
FIG. 7 a perspective view of the display board invention with extra item holder of claim 6 all attached to a monitor housing of a personal computer.

FIG. 7 is a perspective view of the display board invention 10 with extra item holder 300 of FIG. 6 all attached to a monitor housing 19 of a personal computer, where a photograph 410, calendar 420 and mirror 450, the latter being attachable with fasteners, such as hook/loop fasteners, double sided tape, and the like, can be attached to at least one of the top holder 13, and panels 11, 12.

Display board side panels 11, 12 can be molded with functions and contours built in with very little difference in production costs once a mold has been constructed. For example, manufacturing costs for the side display panel with a built-in pad holder will be almost the same as without this feature.

Accessories such as mirrors 450 and other holders are easily attached to the side panel by either clips, bonding agents or other means of fastening them directly to the side panel. This also adds features and functionality to the product with very little additional cost. Clips can also be used to attach other items around the periphery of the side panels. Sticky-back notes are easily applied and removed from the front surface of the adjustable display board. Stickers and decals can also be applied to all surfaces of the adjustable display board. The plastic surface will allow some stickers to be easily removed. Permanent attachment of items can be achieved by the use of adhesives, glues, welding, mounting hardware or other such means. Holes/slots can be put into panels for the means of attaching or providing other functions such as key holders, and the like.

While the preferred embodiment describes used with computer monitors, the invention can be used with television monitors, and the like, or with other things surrounded by a frame.

Although the preferred embodiment is shown with flat outside edges, other variations could include different shapes of the inside and outside edges of the display board, including wavy patterns. The surface of the display board may also contain holes or openings or any of a number of 3-D raised patterns molded into the display board. Attachments to the display board may be added to provide similar effects.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An adjustable display board for monitors, comprising:

a left side panel having an upper horizontal leg and a lower vertical leg arranged in an L-shape to one another, the left side panel having a single front planar surface;

a right side panel having an upper horizontal leg and a lower vertical leg arranged in an L-shape to one another, the right side panel having a single front planar surface;

a top holder panel having a left end and a right end, the left end for allowing a portion of the upper horizontal leg of the left side panel to slidably fasten to the left end, the right end for allowing a portion of upper horizontal leg of the right side panel to slidably fasten to the right end, wherein the left side panel, the right side panel and the top holder panel fits over and in front of a left side edge, a right side edge and a top edge of a monitor, and the single front planar surface of the left side panel and the single front planar surface of the right side panel are similar; and an item holder for supporting an item chosen from at least one of: a writing implement, a pad and a key, wherein the item holder has a front face for supporting the pad,"wherein the front face is slanted with a bottom lip edge" has been inserted after "supporting the pad".

2. The adjustable display board of claim 1, wherein the monitor has a surface face that is curved, and each of the left side panel, the right side panel and the top holder panel are formed from a material that can flex and conforms to the curved surface face of the monitor.

3. The adjustable display board of claim 1, wherein the left side panel and the right side panel each have a rear face with a member protruding perpendicularly behind the rear face, and the single front planar surface of the left side panel and the right side panel each have a t-cross-sectional shape to their respective rear facing perpendicular members, so that a portion of the rear protruding member of both the left side panel and the right side panel can abut against outer side edges of the monitor, while front edges of the left side panel and the right side panel which face one another overlap front face edge portions of the monitor.

4. The adjustable display board of claim 3, wherein the rear protruding member is on both the upper horizontal leg and the lower vertical leg of both the right side panel and left side panel.

5. The adjustable display board of claim 1, wherein the top holder panel includes:

a track for holding both the upper horizontal leg of the right side panel and the upper horizontal leg of the left side panel to the top holder panel.

6. The adjustable display board of claim 1, wherein the top holder panel includes:

means on a front surface of the top holder panel for supporting a card shaped item.

7. The adjustable display board of claim 6, wherein the card shaped item is chosen from at least one of: a photograph, a business card, a calender, a nameplate, and a mirror.

8. The adjustable display board of claim 6, wherein the front means include:

at least one channel edge.

9. The adjustable display board of claim 6, wherein the top holder panel includes:

means on a rear face of the top holder panel for supporting the card shaped item.

10. The adjustable display board of claim 9, wherein the card shaped item is chosen from at least one of: a photograph, a business card, a calender, a nameplate, and a mirror.

11. The adjustable display board of claim 9, wherein the front means and the rear means each include: at least one channel edge.

12. The adjustable display board of claim 1, wherein the item holder includes:

a round opening for supporting the writing implement.

13. The adjustable display board of claim 1, further comprising:

a mirror that is attached to at least one of the right side panel, the left side panel and the top holder panel.

14. An adjustable display board for different sized monitors having flat and contour curved front face edges, the display board for fitting about and in front of left and right and top edges of the monitors, comprising in combination:

a single flexible left side panel having an upper horizontal leg and a lower vertical leg arranged in an L-shape to one another, the left side panel having a single front planar surface;

a single flexible right side panel having an upper horizontal leg and a lower vertical leg arranged in an L-shape to one another, the right side panel having a single front planar surface; a single flexible top holder panel having a left end and a right end, the left end for allowing a portion of the upper horizontal leg of the single left side panel to slidably fasten with the left end, the right end for allowing a portion of the upper horizontal leg of the upper right side panel to slidably fasten to the right end, wherein the single left side panel, the single right side panel and the single top holder panel fits over and in front of a left side edge, a right side edge and a top edge of a monitor, and the single front planar surface of the left side panel and the single front planar surface of the right side panel are in an identical plane with one another, the single flexible top holder covering forming a complete display surface above the top of the monitor so that no gaps exist above the monitor, and the adjustable display board can flex and bend over curved contour front surface edges and flat surface edges of the monitor;

a first channel track attached to an upper edge of the top holder panel having first opening on a front face of the top holder panel; and a second channel track attached to a lower edge of the top holder panel having a second opening on the front face of the top holder panel, the first opening and the second opening facing one another, the first channel and the second channel being in an identical planes with one another, the first channel and the second channel each being capable of holding edges of cards within the first opening and the second opening.

15. The adjustable display board of claim 14, wherein the single left side panel and the single right side panel each have a rear face with a member protruding perpendicularly behind the rear face, and the single front planar surface of the single left side panel and the single right side panel have a t-cross-sectional shape to their respective rear facing perpendicular members, so that a portion of the rear protruding members of both the single left side panel and the single right side panel can abut against outer side edges of the monitor, while inner front edges of the left side panel and the right side panel which face one another overlap the front face portions of the outer side edges of the monitor.

16. The adjustable display board of claim 15, further comprising:

an item holder for supporting an item chosen from at least one of: a writing implement, a pad and a key, the item holder having a front face for supporting the pad.

17. The adjustable display board of claim 1, further comprising:

a first channel track attached to an upper edge of the top holder panel having first opening on a front face of the top holder panel; and a second channel track attached to a lower edge of the top holder panel having a second opening on the front face of the top holder panel, the first opening and the second opening facing one another, the first channel and the second channel each being capable of holding edges of cards within the first opening and the second opening.

18. An adjustable display board for different sized monitors having flat and contour curved front face edges, the display board for fitting about and in front of left and right and top edges of the monitors, comprising in combination:

a single flexible left side panel having an upper horizontal leg and a lower vertical leg arranged in an L-shape to one another, the left side panel having a single front planar surface;

a single flexible right side panel having an upper horizontal leg and a lower vertical leg arranged in an L-shape to one another, the right side panel having a single front planar surface;

a single flexible top holder panel having a left end and a right end, the left end for allowing a portion of the upper horizontal leg of the single left side panel to slidably fasten with the left end, the right end for allowing a portion of the upper horizontal leg of the upper right side panel to slidably fasten to the right end, wherein the single left side panel, the single right side panel and the single top holder panel fits over and in front of a left side edge, a right side edge and a top edge of a monitor, and the single front planar surface of the left side panel and the single front planar surface of the right side panel are in an identical plane with one another, the single flexible top holder covering forming a complete display surface above the top of the monitor so that no gaps exist above the monitor, and the adjustable display board can flex and bend over curved contour front surface edges and flat surface edges of the monitor; and an item holder for supporting an item chosen from at least one of: a writing implement, a pad and a key, the item holder having a front face for supporting the pad, "wherein the front face is slanted with a bottom lip edge".

* * * * *